United States Patent [19]

Krstovic

[11] Patent Number: 5,058,339

[45] Date of Patent: Oct. 22, 1991

[54] CURVED STAIRWAY AND METHOD

[76] Inventor: Alexander P. Krstovic, P.O. Box 2353, Easley, S.C. 29641

[21] Appl. No.: 595,989

[22] Filed: Oct. 11, 1990

[51] Int. Cl.[5] ..... E04F 11/10

[52] U.S. Cl. ..... 52/187; 182/93; 182/194; 182/228

[58] Field of Search ..... 52/182, 184, 187; 182/93, 228, 194

[56] References Cited

U.S. PATENT DOCUMENTS

| | | | |
|---|---|---|---|
| 983,213 | 1/1911 | Dahill et al. | 182/228 |
| 3,616,585 | 11/1971 | Cirgenski et al. | 52/187 |
| 3,902,948 | 9/1975 | Morros | 52/187 |
| 4,135,508 | 1/1979 | Lyons | 182/93 |
| 4,143,740 | 3/1979 | Matthews | 182/93 |
| 4,527,366 | 7/1985 | Green et al. | 52/187 |

FOREIGN PATENT DOCUMENTS

| | | | |
|---|---|---|---|
| 162250 | 5/1948 | Austria | 182/194 |
| 818687 | 10/1951 | Fed. Rep. of Germany | 52/187 |
| 557883 | 5/1923 | France | 52/187 |
| 617432 | 2/1949 | United Kingdom | 52/187 |

*Primary Examiner*—James L. Ridgill, Jr.
*Attorney, Agent, or Firm*—Bailey & Hardaway

[57] ABSTRACT

A curved stairway is illustrated wherein the usual wooden components, including the stringers A, are provided with steel reinforcement, including metallic stringers B provided with cross bracing D and E in order to provide a composite structure affording rigidity with minimal reinforcement.

3 Claims, 2 Drawing Sheets

CURVED STAIRWAY AND METHOD

BACKGROUND OF THE INVENTION

This invention relates to curved stairways and more particularly to a reinforced construction and method providing rigidity with minimal reinforcing.

It is desirable to fabricate a curved stairway capable of extending between a floor and a balcony that possesses an attractive appearance while simultaneously providing structural integrity with a minimum amount of reinforcement. Heretofore curved stairways have been constructed of wood requiring substantial thicknesses and special reinforcement. When loads are placed at marginal unsupported locations on curved stairs, substantial stresses are introduced into the structure causing the stair to flex and move.

Accordingly, it is an important object of the invention to provide a curved stairway of rigid construction.

Another important object of the invention is to provide a stairway having a composite reinforced construction of wood with steel reinforcement which will minimize the amount of reinforcing material required for rigidity.

Still another important object of the invention is to provide a method of fabricating a curved stairway whereby the stairway may be built either at its desired permanent site or at a site remote therefrom.

SUMMARY OF THE INVENTION

It has been found that a curved stairway extending between a floor and a balcony may be provided wherein a pair of wooden stringers have steel reinforcement extending between them. The reinforcement is such that flat bar stringer members may be curved to conform to the inner surfaces of the stringers and serve as a support for bracing affording rigidity to extend therebetween. A number of structural sections, such as channel members, are spaced and extend between the flat bar stringers. Suitable bracing is further provided by structural sections which extend diagonally as between corners of the channel members.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
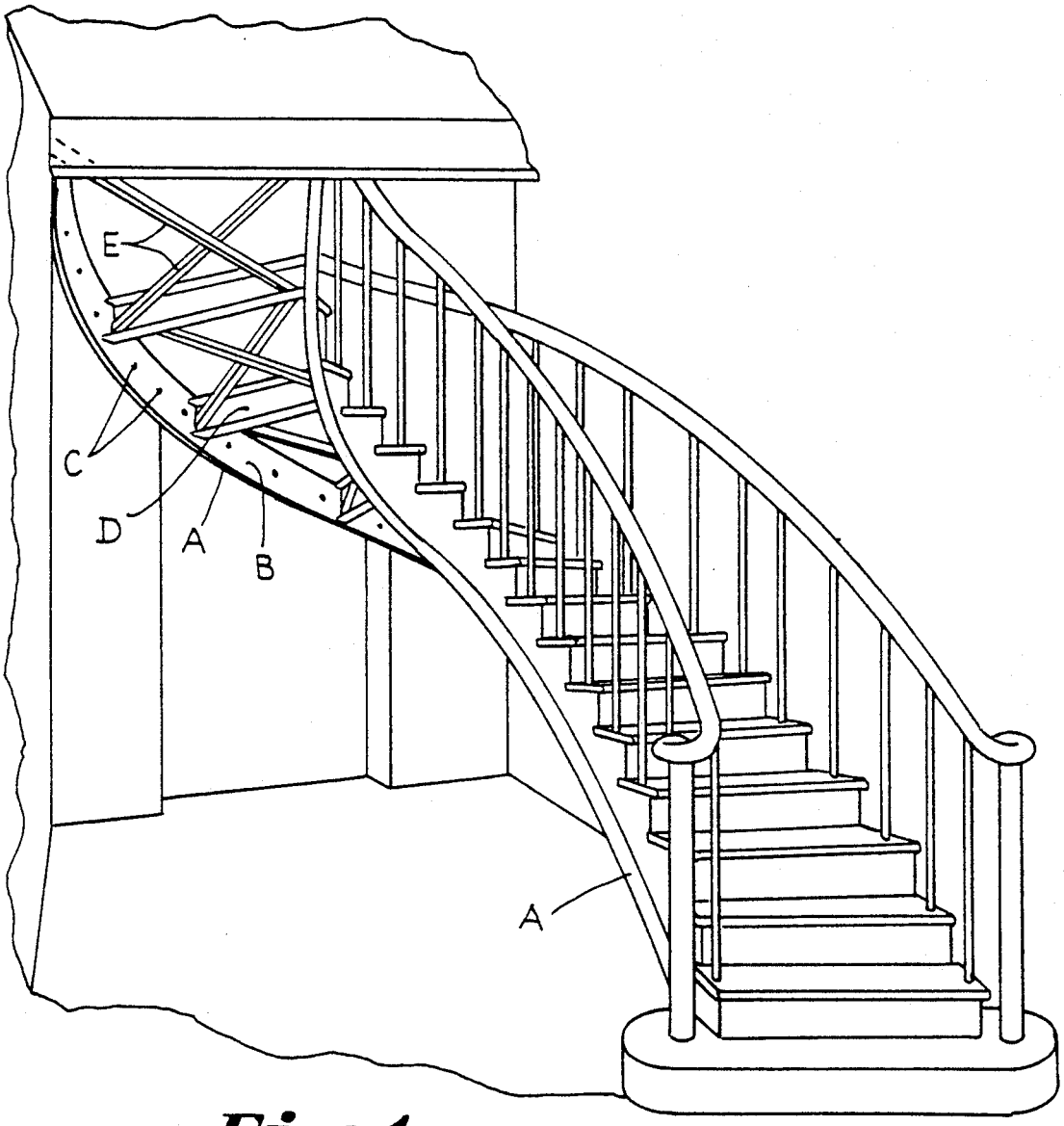
FIG. 1 is a perspective view from the front illustrating a curved stairway constructed in accordance with the invention.
Figure 2:
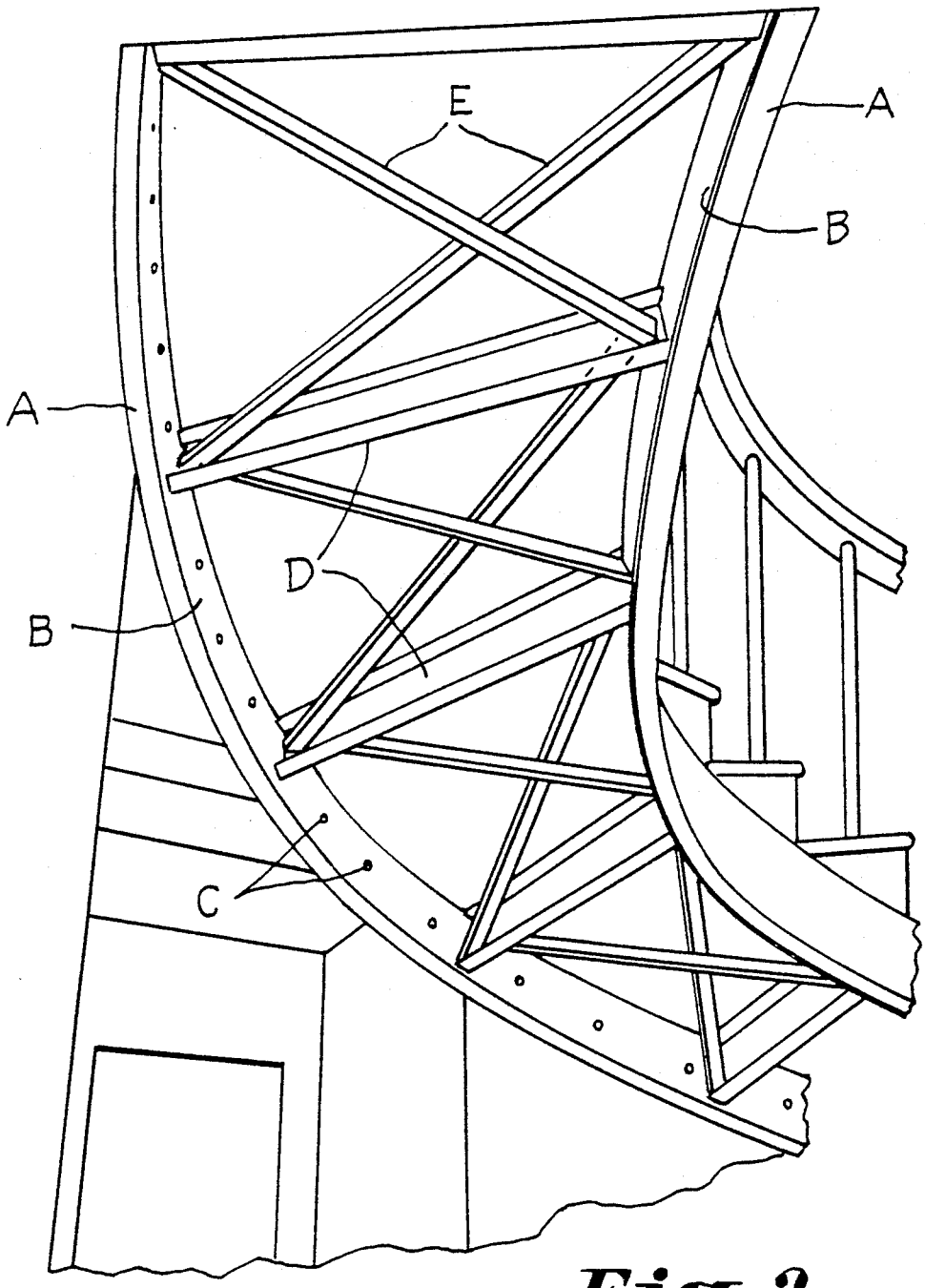
FIG. 2 is a perspective view of the underside of the stairway, illustrating reinforcement of the wooden stairway.

The drawings illustrate a curved stairway extending between a floor and a balcony. Spaced opposed upright curved wooden stringers A extend vertically along and form marginal portions of the stairway. Flat metal bars B forming metal stringers extend along an inside surface of the wooden stringers and conform to the curvature of the wooden stringers. A fastener C secures the flat metal bar stringers to the wooden stringers and causes the stringers to function as a structural unit. A plurality of first spaced structural sections D extend transversely across the stairway between the metal stringers. Suitable means such as welding fix the first structural sections to the metal stringers adjacent respective ends thereof. A plurality of second structural sections E extend between next adjacent first structural sections forming cross bracing extending between opposite corners of the first structural sections. Thus, rigidity and structural integrity is imparted to the curved stairway with minimal reinforcing.

Referring more particularly to the drawings, it will be noted that the stairway includes wooden stringers A between which extend the usual treads 10 and risers 11. The stairway may include a platform 12 carried by the floor and extends upwardly to the balcony 13. Banisters 14 are provided to support a pair of rails 15. Such a wooden construction is incapable without reinforcement of supporting the loading under the varying conditions imposed by regular use.

The method of building the curved stairway contemplates initially bending a flat metal bar B to conform to the wooden stringer A. The bars B, bearing against the inside faces of wooden stringers A, are then suitably secured as by spaced C-clamps provided to temporarily hold the bars B against the stringers A, and the bars are then permanently fixed to the stringer A as by fasteners C which may be advantageously provided as screws. The bar members assume or conform to the curvature of the wooden stringers.

The metal stringers are then connected together by a plurality of first structural sections D, which are transversely spaced across the stairway between metal stringers B. Suitable means such as welding fix the first structural sections to the metal stringers adjacent respective ends thereof. A plurality of second structural sections E extend between the next adjacent first structural sections, forming cross bracing extending between opposite corners of the first structural sections. The first and second structural sections may also be fixed together by such suitable means as welding. Thus, the structural configuration shown imparts sufficient rigidity and structural integrity to the stairway with minimal reinforcement.

The fabrication of the stairway may take place either at the building in which it is to be permanently placed or at a remote site, wherefrom a substantially completed stairway may be shipped to said building.

While the invention has been described in terms of an elliptical stairway as shown in the drawings, curved stairways of any configuration are contemplated by the invention. For example, spiral or circular constructions may be readily adapted to the invention with the similar advantages in rigidity and facility of construction.

While a preferred embodiment of the invention has been described using specific terms, such description is for illustrative purposes only, and it is to be understood that changes and variations may be made without departing from the spirit or scope of the following claims.

What is claimed is:

1. A curved stairway extending between a floor and a balcony comprising:

spaced opposed upright curved wooden stringers extending vertically along and forming marginal portions of said stairway;

flat metal bars forming metal stringers extending along an inside surface of said wooden stringers conforming to the curvature of said wooden stringers;

a fastener securing said flat metal bar stringers to said wooden stringers causing the stringers to function as a structural unit;

a plurality of first spaced structural sections extending transversely across said stairway between said metal stringers;

means fixing said first structural sections to said metal stringers adjacent respective ends thereof; and a plurality of second structural sections extending between next adjacent first structural sections forming cross bracing extending between opposite corners of said first structural sections;

whereby rigidity and structural integrity is imparted to said curved stairway with minimal reinforcing.

2. The structure set forth in claim 1 wherein said first structural sections are channel members and said second structural sections are angles.

3. The structure set forth in claim 1 wherein said fastener includes a plurality of spaced screws, and wherein respective ends of said first and second structural sections are welded to said metal stringers.

* * * * *